United States Patent [19]

Kuhr et al.

[11] 3,998,020

[45] Dec. 21, 1976

[54] ADJUSTABLE SUSPENSION SYSTEMS FOR CEILINGS

[75] Inventors: Albert F. Kuhr, Elk Grove Village; Edward R. Lau, Des Plaines; Harold Bartels, Villa Park, all of Ill.

[73] Assignee: United States Gypsum Company, Chicago, Ill.

[22] Filed: Nov. 3, 1975

[21] Appl. No.: 628,308

[52] U.S. Cl. ..... 52/484; 52/586; 52/588; 52/495; 52/498

[51] Int. Cl.[2] ..... E04B 5/52; E04C 1/10

[58] Field of Search ..... 52/484, 477, 490, 586, 52/588, 489, 496, 495, 488, 665, 485, 498

[56] References Cited

UNITED STATES PATENTS

| | | | |
|---|---|---|---|
| 2,186,459 | 1/1940 | Levy | 52/490 |
| 3,034,609 | 5/1962 | Young | 52/489 |
| 3,035,672 | 5/1962 | Tuten et al. | 52/484 |
| 3,066,775 | 12/1962 | Valsvik | 52/496 |
| 3,390,856 | 7/1968 | Van Buren, Jr. | 52/489 |
| 3,708,941 | 1/1973 | Cuckson | 52/484 |
| 3,832,816 | 9/1974 | Jahn | 52/496 |

*Primary Examiner*—Price C. Faw, Jr.
*Assistant Examiner*—Robert C. Farber
*Attorney, Agent, or Firm*—Donnie Rudd; Samuel Kurlandsky; Robert H. Robinson

[57] ABSTRACT

An apparatus is disclosed for leveling suspended ceilings while attaching them to supporting structures. The apparatus has an upper body portion having a backplate, a top plate, and a side plate with each of the plates lying in a plane substantially perpendicular to the plane of the other two plates and each of the plates having means for connection to a supporting structure. A flange extends downwardly from one of the plates and includes means for engaging the supporting portion of a suspended ceiling.

6 Claims, 13 Drawing Figures

ADJUSTABLE SUSPENSION SYSTEMS FOR CEILINGS

BACKGROUND OF THE INVENTION

1. Field of the Invention

This invention relates to an apparatus for concurrently leveling and attaching suspended ceilings to supporting structures.

2. Description of the Prior Art

Suspended ceilings are common in the building industry. Such ceilings normally include parallel runner bars supportable from hangers of adjustable length which are in turn attached in some way to the ceiling joists. The location of the joists varies significantly throughout a single ceiling in order to accommodate other design features such as placement of utilities. Even though the ceiling joist may vary significantly in location, it is desirable for purposes of appearance to have the suspended ceiling lie in a single plane rather than follow the joist variations. In order to accomplish this result, it is important to devise a system for accommodating the irregularities in location of the joists and regardless of the irregularities to provide a runner system which has a suspended ceiling lying in a single plane.

Many different systems have been devised for attaching suspended ceiling runners to ceiling joists. Perhaps the earliest and most common method of attaching the runners was a wire attached to the joist and passed through a hole in the runner and then appropriately bent to adjust the runner to the desired height. This system, however, was not a rigid construction and slight movements of the runner resulting from the non-rigid construction rendered the system undesirable. One improvement on this prior system is shown in U.S. Pat. No. 3,032,833. This design makes use of a wire attached to the joist or other portion of the ceiling, which then passes through a hole in an L-shaped support. A bolt passes through the bottom of the L-shaped support, and the bolt has a hook on its end for insertion into the runner. This system, however, still does not provide a rigid system, and, furthermore, requires that the holes in the runner exactly accommodate the suspended wires in order to provide attachment.

Substitution of rigid bolts for the previously used suspending wires is now common and is further illustrated in U.S. Pat. No. 3,708,941. In this patent, however, the rigid bolt is attached to a clip which is then attached to the ceiling runner. This system, however, is not completely rigid and lacks adaptability in that the attachment to the stud is either restricted or else a multiplicity of different attachment devices must be used in order to give the desired adaptability. This is undersirable in that it creates the need for many different parts rather than making use of a single attachment apparatus for all different ceiling joist configurations.

In Austrailian Patent Specification No. 204,140, rigid hangers are suspended from the joists and then connected to inverted-T runners with the advantage that the suspended hangers are interconnected by stabilizers above the runner in order to provide a rigid system. This design, however, lacks adaptability in that it only provides for one specific type of attachment on the lower side of a ceiling joist. If utilities or the like prevent this attachment at an exact location, then extensive design alterations must be made in order to accommodate the system. In French Pat. No. 1,181,986, an L-shaped member is attached to the lower side of a ceiling joist and the projecting portion of the L-shaped attachment device is attached to an inverted-T runner. Slots are provided in the L-shaped member in order to adjust the height of the inverted-T runner. This system, however lacks adaptability in that different sizes of L-shaped members must be used for significant variations in joist location, and, furthermore, the inverted-T runner must be designed with its connecting portion in a flat plane or else the inverted-T runner will not have the bottom portion thereof lying in a plane parallel to the plane of the floor and, consequently, the ceiling suspended therefrom will be undesirable.

In Canadian Pat. No. 741,946, a bolt is attached to the ceiling joist in a manner which allows it to be adjusted up and down to change the height of the ceiling. The bottom of the bolt is attached to a clip for clipping onto an inverted-T runner. This system provides only one type of attachment to a joist on the underneath portion thereof, thereby severely limiting its adaptability and additionally releasably secures the inverted-T runner in a design that falls far short of being a rigid system. Additionally, the ceiling tile must be cut away at its back edges in order to accommodate the T-runner clip, and this severely restricts the type of ceiling tile that may be suspended by the system.

In U.S.S.R. Pat. No. 259,729, a rigid support is attached to the ceiling joist and has good adaptability even though it requires a plurality of innerconnected pieces for adjustment thereof. The bottom portion of the suspension system, however, requires opposing hooks having a spring-like design for engagement in the upper portion of a very specific type of inverted-T runner. While this system has some adaptability for accommodating different locations of ceiling joists, it is severely restricted in that it will only accommodate one type of T-runner and is therefore not useful in a wide variety of ceiling systems. In French addition Pat. No. 70,110, the bottom connection piece for suspension of a T-runner is illustrated in one of its more complex forms. While the system is adaptable with regard to adjustment of the height of the ceiling, the complexity and number of pieces severely limits the adaptability of the system.

In one further embodiment described in the prior art, U.S. Pat. No. 3,390,856 has a clip for attachment to the upper portion of an inverted-T runner and the clip is attached to a flange suspended from a ceiling joist. This system not only fails to provide for adaptability of the upper portion of the system which connects to the joist, but in addition, requires a critically designed bulbous upper portion of the inverted-T in order to accommodate the clip. Such a requirement severely restricts the adaptability of the system.

In the new and novel attachment device of this invention, the upper portion thereof is highly adaptable and can be attached to any exposed face of a ceiling joist. Regardless of the location of the ceiling joist, the upper portion of the attachment device can readily accommodate it. The bottom portion of the attachment device can readily accommodate an inverted-T runner regardless of the design of the inverted-T runner, and the invention makes use of a novel clip-type arrangement for accommodating the various designs of T-runners. The combined teachings of all of the prior known systems do not result in an attachment device with the adaptability and utility shown in the present invention.

SUMMARY OF THE INVENTION

It is an object of this invention to provide an adjustable support for suspended ceilings permitting the ceiling height to be properly adjusted during construction.

It is an additional object of this invention to provide a new method for installing suspended ceilings.

The objects of this invention are accomplished by an apparatus for concurrently leveling and attaching suspended ceilings to supporting structures, said apparatus comprising:

an upper body portion comprising a back plate having attached thereto a top plate and a side plate, each of said plates lying in a plane substantially perpendicular to the plane of the other two plates, and each of said plates having means for connection to a supporting structure; and, a flange extending downwardly from one of the plates and adapted for engaging the supporting portion of a suspended ceiling. Preferably, the downwardly extending flange has an inverted-T runner attached thereto for suspension of a ceiling. Also, preferably, the downwardly extending flange has a clip encircling a portion of the bottom thereof and an inverted-T runner is attached to the flange through the clip. The clip serves to space apart the T-runner and flange in addition to providing a backup system for attachment. The preferred embodiment for attachment of the apparatus to the ceiling joist is an adjustable bolt which can be attached to the joist and by use of nuts thereon can adjust the location of the attachment device anywhere along the attaching bolt. The extreme versatility of the attachment device enables an attachment along the side of the joist, underneath the joist, through a covering material into the joist, through simply a covering material, or through almost any other type of configuration of the ceiling joist system. The attachment device is particularly adaptable to inverted-T runners in which the top portion, after inversion, is enlarged to provide additional strength to the T-runner. In such a design of a T-runner, the clip that is used with the attachment device enables the T-runner to be attached in the alignment necessary to provide a ceiling along a proper plane.

BRIEF DESCRIPTION OF THE DRAWINGS

This invention may be more fully described and defined by the embodiment shown in the attached drawings wherein.

DESCRIPTION OF THE PREFERRED EMBODIMENTS

Figure 1:
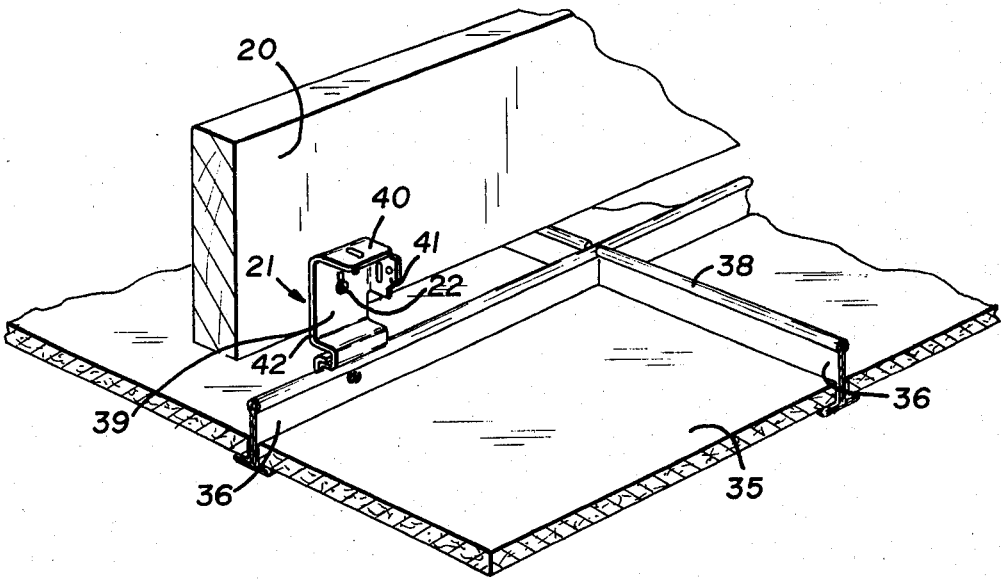
FIG. 1 is a perspective view of an assembled ceiling utilizing the attachment device of this invention.
Figure 5:
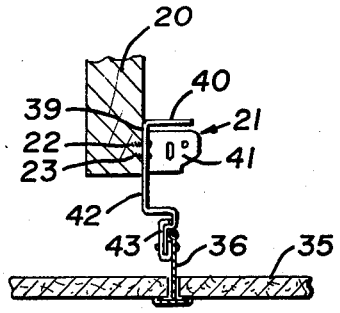
FIG. 5 is a side view of the installed attachment device of this invention showing the attachment to the side of a joist and showing an inverted-T runner used to suspend ceiling tile.
Figure 6:
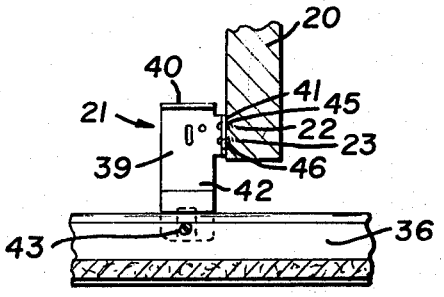
FIG. 6 is a side view of a suspended inverted-T runner showing a different mode of attachment using the attachment device, but also showing the device attached to the side of the ceiling joist and to an inverted-T runner.

The attachment device of this invention is more fully described by reference to the embodiments illustrated in the attached drawings wherein a ceiling joist 20 is the basic supporting structure for the ceiling. An attachment device 21 is attached to the joist. In FIG. 1 the attachment is by a screw 22 directly into the joist through a hole in the attachment device. In FIGS. 5 and 6, the attachment is made directly into the side of the joist by utilizing screws 22 and 23 through holes 45 and 46 in the attachment device.

Figure 3:
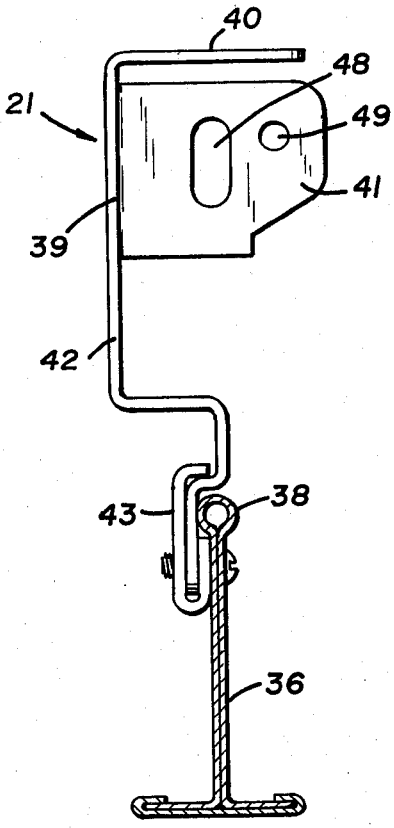
FIG. 3 is an end view of the attachment device of this invention.
Figure 2:
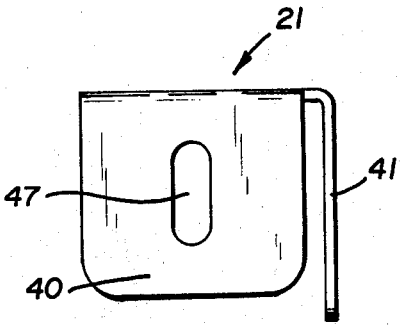
FIG. 2 is a top view of the attachment device of this invention.
Figure 4:
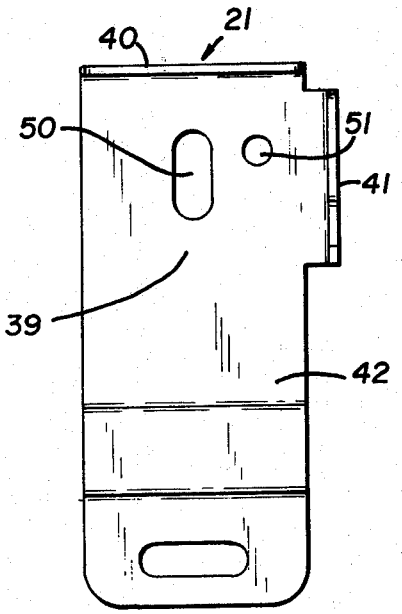
FIG. 4 is a front view of the attachment device of this invention.

Referring to FIGS. 2–4, holes 47, 48, 49, 50, and 51 are shown for allowing screw attachment to the joists. A preferred embodiment of the invention requires that holes 47, 48, and 50 be exactly centered over the connection portion of the downwardly extending flange in order that on the occasion of a loose screw the inverted-T runner will still hang in exact alignment. The other holes 49 and 51 permit a second screw enabling a rigid construction.

Figure 7:
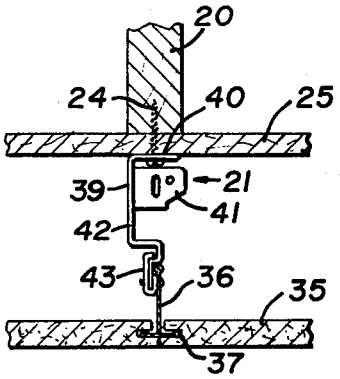
FIG. 7 is a side view of the attachment device supporting an inverted-T runner which in turn supports kerfed ceiling tiles, and with the attachment device being attached to the joist through a first ceiling installed under the joists.
Figure 8:
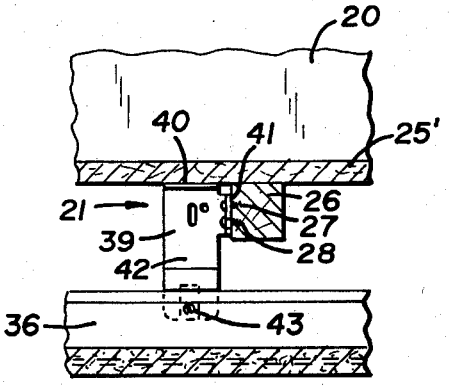
FIG. 8 is a side view of another embodiment of the attachment device shown supporting an inverted-T runner and with the attachment device being attached to furring strips across the ceiling joist.
Figure 9:
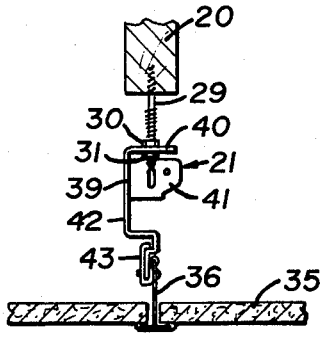
FIG. 9 is a side view of a suspended ceiling using the attachment device of this invention and being supported from a wood joist by a bolt screwed into the joist and having nuts thereon for adjustment of the attachment device.
Figure 10:
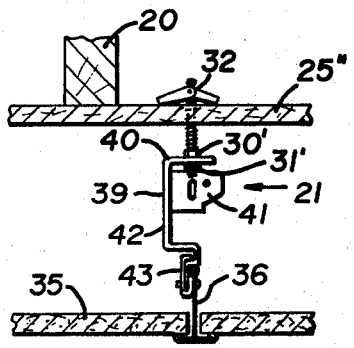
FIG. 10 is a side view of a ceiling using the attachment device of this invention with the attachment device supported by a toggle bolt having adjustable bolts on the suspended end thereof for adjusting the height of the attachment device.
Figure 11:
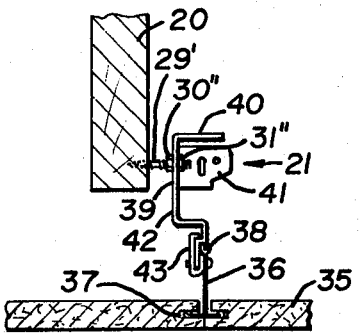
FIG. 11 is a side view of a suspended ceiling using the attachment device of this invention showing the attachment by use of a bolt screwed into the side of a wooden joist and having nuts thereon for lateral adjustment of the location of the attachment device.
Figure 12:
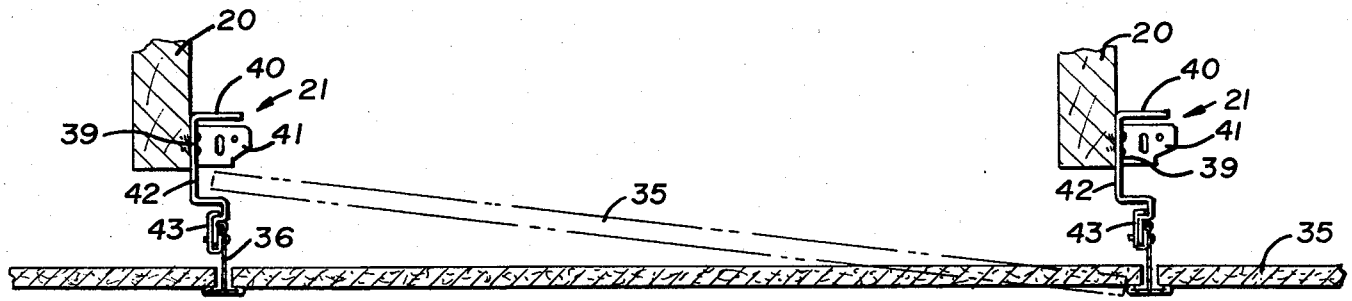
FIG. 12 is a side view of an assembled ceiling using the attachment device of this invention and showing in phantom the method of installation of the ceiling tile on top of an inverted-T runner supported by the attachment device of this invention.
Figure 13:
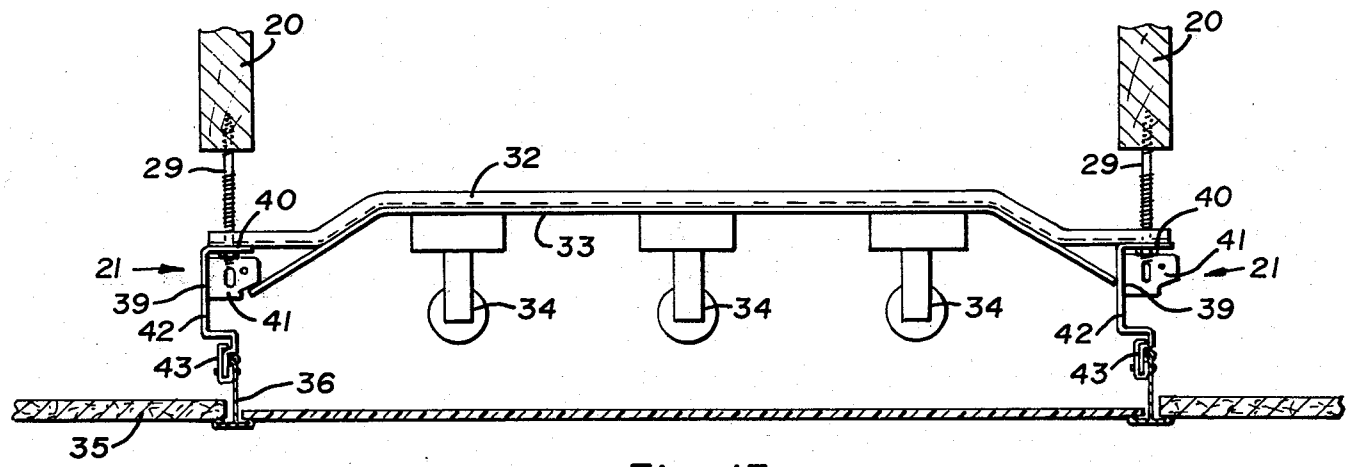
FIG. 13 is a side view of a suspended ceiling using the attachment device of this invention attached by use of adjustable bolts and further illustrating the installation of a suspended light system attached to the attachment device of this invention and having inverted-T runners supporting ceiling tile on one side and the translucent panel of the light fixture on the other side.

FIG. 7 illustrates a screw 24 passing through a covering 25 and being attached to the joist 20. FIG. 8 illustrates a covering 25' having a furring strip 26 attached through the covering to the joist 20 and having screws 27 and 28 through holes in the attachment device attached to the furring strip. In FIG. 9 a bolt 29 is screwed directly into the bottom of the joist and adjustable nuts 30 and 31 are screwed onto the suspended end of the bolt through a flange on the attachment device thereby enabling the attachment device to be adjusted to the desired location. In FIG. 10 the adjustment of the attachment device is the same using nuts 30′ and 31′ but the upper portion of the bolt is a toggle bolt 32 attached to the covering 25″ which is in turn attached to the joist 20. In FIG. 11 the attachment device is attached through a back flange to the side of joist 20 by use of bolt 29′ and bolts 30″ and 31″. In FIG. 12 the attachment is the same as in FIG. 5 with the attachment being by screws to the side of the joist. In FIG. 13 the attachment is the same as in FIG. 9 with the exception that the bolt 29 passes through the light housing 32 which in turn supports the light reflector 33 and lights 34. In the system, ceiling tiles 35 may simply sit on the top of an inverted-T runner 36 or may be attached to the T-runner by the T-runner engaging kerfs in the ceiling tile, such as kerfs 37 shown in FIGS. 7 and 11. In a preferable embodiment of this invention, as demonstrated in FIG. 3 the inverted-T runner has an enlargement 38 at the upper portion of the inverted-T for use in strengthening the T-runner.

Referring to FIGS. 1–4, the attachment device of this invention has a backplate 39, a top plate 40, and a side plate 41, each lying in a plane substantially perpendicular to the plane of the other two plates. A downwardly extending flange 42 extends downward from one of the plates and terminates in a design which enables the engagement with a supporting portion of a suspended ceiling. Many types of structure may be used at the downward terminal portion of the attachment device, however, the embodiment shown in the drawings is one of a question mark shape which is not only useful for strengthening the downwardly extending flange but additionally enables the T-runner to be attached in a central alignment with the flanges. Of particular importance is the embodiment of this invention wherein a clip 43 encircles a portion of the bottom of the downwardly extending flange and an inverted-T runner is attached to the flange through the clip. In such an embodiment, the clip spaces apart the flange and the T-runner in addition to providing a means for attaching the T-runner to the attachment device. Additionally, when an inverted-T runner is used to support the ceiling, and the inverted-T runner is enlarged at its inverted top portion, such as enlargement 37, the clip provides for exact vertical alignment of the vertical web of the T-runner rather than creating a skewing due to contact of the flange with an irregular outer surface of the main web of the runner.

The new and novel attachment device of this invention is more versatile than anything previously shown. As illustrated in the drawings, the device may be attached either to the bottom or sides of the ceiling joist or may be attached through a first ceiling or false ceiling or may be attached to furring strips placed over a ceiling or the studs. Additionally, the device may be attached simply to a previously installed ceiling by use of toggle bolts or the like. The ceiling, thus constructed, is highly adaptable. In FIG. 12, the illustration of the installation of the ceiling tile shows that the tiles can be readily installed and removed without difficulty. Still further demonstrating the adaptability of the attachment device, FIG. 13 illustrates the easy adaptability of the device when light fixtures are recessed within the ceiling. Although not shown, the attachment device can easily be incorporated in systems which have air plenums recessed within the ceiling or which have other desirable systems recessed within the ceiling, such as speakers and other types of air control systems. The type of attachment of the attachment device to the ceiling joist or previous ceiling is left to the desire of the person using the attachment device, and since the attachment device is so readily adaptable to any type of system, a multiplicity of alternatives is provided in order to accommodate any design feature of the ceiling joists. While all of the illustrated embodiments show wood joists with simple screw-type attachments to the joist, it must be understood that within the scope of this invention is included other types of joists, such as metal joists, in which the attachment device can be attached simply by screwing it thereto or wherein a clip can be attached to the metal joist and the attachment device thereafter attached to the clip.

In installation of the ceilings made possible by the attachment device of this invention, the skilled craftsman can determine the desired location of the inverted-T runner and then can install the attachment device with the T-runner in the desired location. Whether or not the T-runner is first installed to the attachment device or the attachment device is first installed on the joist and then the T-runner is attached thereto is a matter of discretion with the skilled craftsman who can readily determine the most convenient and economical way for installation of the system.

It may thus be seen that the new and novel attachment device made possible by this invention is a highly adaptable attachment device that produces significant advantages over all attachment devices previously known and including a combination of all of the better features of previously known systems. The adaptability of the system is significantly greater than anything previously shown. Additionally, the system provides for a rigid ceiling which restricts movement of the T-runners and thereby provides a rigidity heretofore unknown in systems of highly adaptable attachment. Additionally, the attachment device makes use of whatever type of connection is necessary in order to provide the proper spacing and location of the inverted-T runners. The adaptability of this system is such that regardless of the irregularities of the ceiling joist or previous ceiling a proper ceiling can be provided usually lying in a uniform plane.

Having fully defined this new and unique invention, the following is claimed:

1. An apparatus for concurrently leveling and attaching suspended ceilings to supporting structures, said apparatus comprising:

an upper body portion comprising a back plate having attached thereto a top plate and a side plate, each of said plates lying in a plane substantially perpendicular to the plane of each of the other two plates, and each of said plates having means for connection to a supporting structure; and, a flange downwardly extending from the upper body portion for engaging the supporting portion of a suspended ceiling; and wherein the downwardly extending flange has a clip encircling a portion of the bottom thereof and an inverted-T runner is attached to the flange through the clip.

2. An apparatus as in claim 1 wherein the downwardly extending flange has an inverted-T runner attached thereto for suspension of a ceiling.

3. An apparatus as in claim 1 wherein the downwardly extending flange has a slot therein and wherein an inverted-T runner is attached thereto by an attachment device extending through the slot.

4. In combination:

a supporting structure;

a bolt attached to the supporting structure;

an attachment device adjustably attached to the bolt, said attachment device comprising: an upper body portion comprising a back plate having attached thereto a top plate and a side plate, each of said plates lying in a plane of the other two plates, and each of said plates having means for connection to a supporting structure; and, said attachment device further having a flange extending downwardly from one of the plates; and an inverted-T runner attached to the downwardly extending flange, and wherein the flange and inverted-T runner are connected by means of a clip which partially encircles the bottom of the flange and spaces it apart from the inverted-T runner and wherein the inverted-T runner is attached to the flange through the clip.

5. The combination as in claim 4 wherein ceiling tiles are supported by the inverted-T runner.

6. A method for installing a suspended ceiling, said method comprising:

a. attaching a bolt to a supporting structure;

b. attaching a leveling and attachment device to the bolt, said leveling and attachment device having: an upper body portion comprising a back plate having attached thereto a top plate and a side plate, each of said plates lying in a plane substantially perpendicular to the plane of the other two plates, and each of the plates have a hole therein, with said attaching to the bolt being an adjustable attachment through one of the holes in one of the plates, and one of said plates having a flange extending downwardly therefrom with said flange having means for suspending a ceiling therefrom; and c. suspending ceiling tile from the means for suspending a ceiling.

* * * * *